US005107567A

United States Patent [19]

Ferrari et al.

[11] Patent Number: 5,107,567

[45] Date of Patent: Apr. 28, 1992

[54] STICK TYPE VACUUM CLEANER WITH A DIRT CUP SECURED BY A FINGER-OPERATED LATCH

[75] Inventors: Marco Ferrari, Bloomington; Michael R. Fowler, Normal; Kelly B. McVey, Bloomington, all of Ill.

[73] Assignee: White Consolidated Industries, Inc., Cleveland, Ohio

[21] Appl. No.: 753,011

[22] Filed: Aug. 23, 1991

Related U.S. Application Data

[63] Continuation of Ser. No. 486,936, Mar. 1, 1990, abandoned.

[51] Int. Cl.[5] ..... A47L 9/20

[52] U.S. Cl. ..... 15/350; 15/344; 15/352; 55/300

[58] Field of Search ..... 15/350, 351, 329, 344, 15/352; 55/300, 473

[56] References Cited

U.S. PATENT DOCUMENTS

| | | | |
|---|---|---|---|
| 2,986,765 | 6/1961 | Ernolf et al. | 15/329 |
| 3,199,139 | 8/1965 | Vallis | 15/532 |
| 3,667,084 | 6/1972 | Valbona et al. | 15/323 |
| 3,797,064 | 3/1974 | MacFarland | 15/351 |
| 3,966,444 | 6/1976 | Clowers et al. | 55/356 |
| 4,644,605 | 2/1987 | Joss et al. | 15/329 |
| 4,662,026 | 5/1987 | Sumerau et al. | 15/329 |
| 4,758,914 | 9/1973 | Nupp et al. | 15/329 |
| 4,766,638 | 8/1988 | McDowell | 15/350 |
| 4,870,714 | 10/1989 | Miner | 15/327 |

FOREIGN PATENT DOCUMENTS

| | | | |
|---|---|---|---|
| 68961 | 4/1949 | Denmark | 55/300 |
| 576044 | 4/1933 | Fed. Rep. of Germany | 55/300 |

*Primary Examiner*—Paul T. Sewell
*Assistant Examiner*—Thomas P. Hilliard
*Attorney, Agent, or Firm*—Pearne, Gordon, McCoy & Granger

[57] ABSTRACT

A lightweight upright vacuum cleaner having a porous filter bag and a re-usable dirt cup in which the handle has two positions for either upright usage, or substantially horizontal usage on stairs, or the like. The cleaner is further provided with a rigid support bar connecting the handle to the base of the vacuum cleaner and which is located outside the porous bag and the dirt cup in order to provide a large volume porous bag and dirt cup.

14 Claims, 11 Drawing Sheets

FIG.12
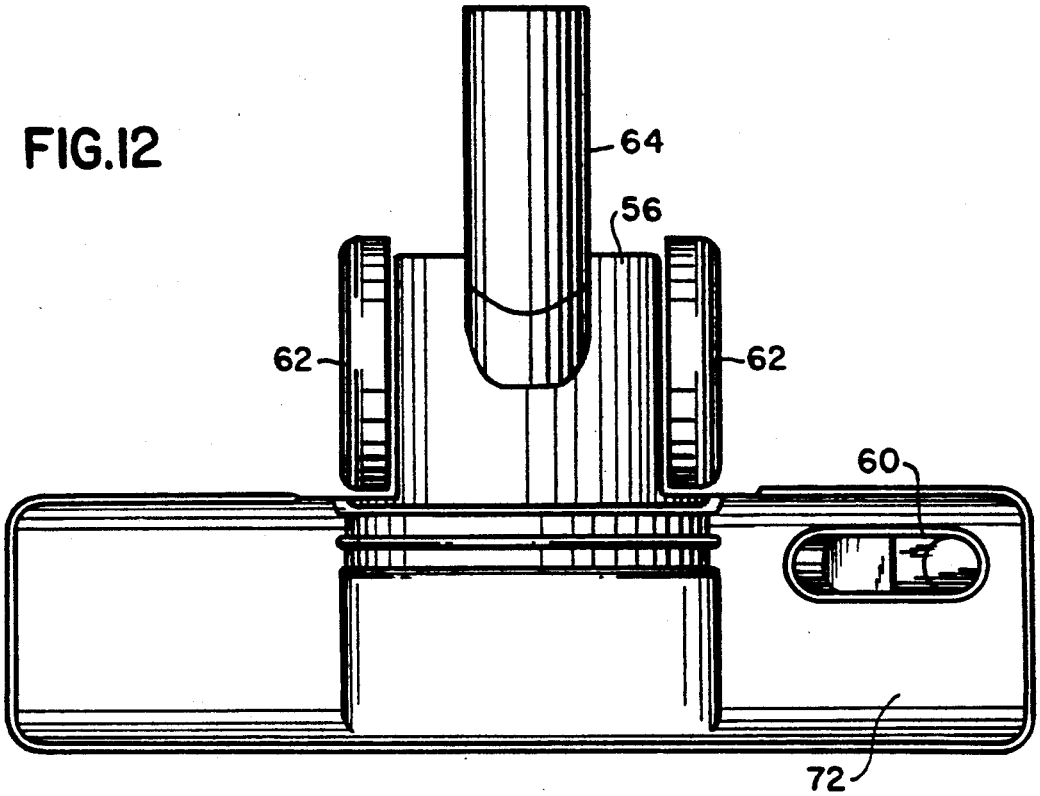
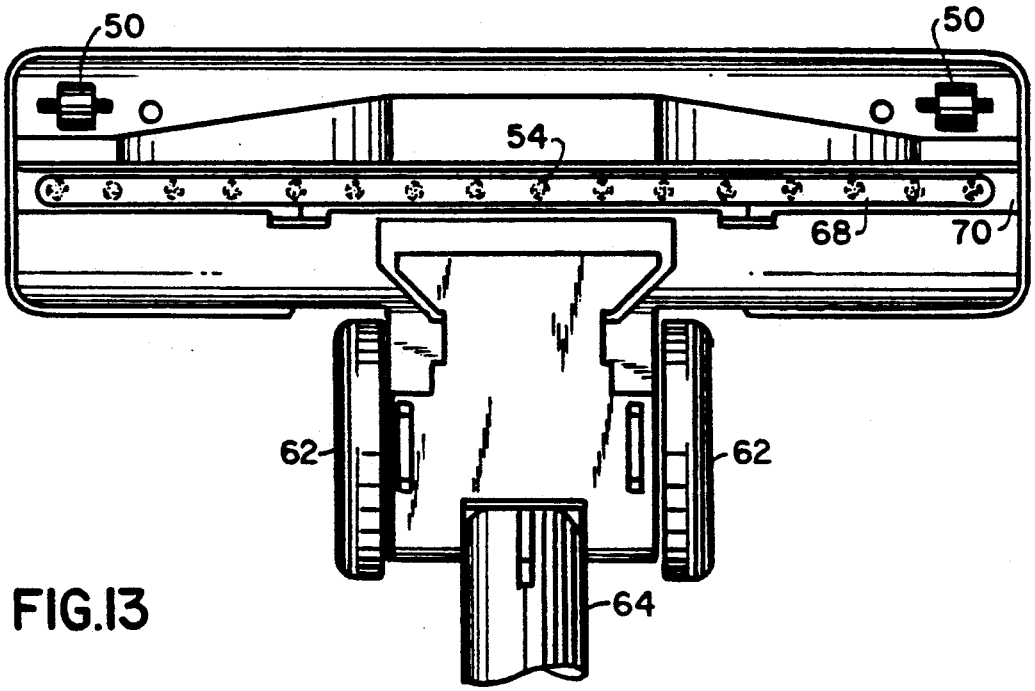
FIG.13

STICK TYPE VACUUM CLEANER WITH A DIRT CUP SECURED BY A FINGER-OPERATED LATCH

This is a continuation of application Ser. No. 07/486,936, filed Mar. 1. 1990, now abandoned.

The present invention relates to a stick type vacuum cleaner having a porous filter bag and a re-usable dirt cup. the latter being for accumulating dirt picked up from the rug, or the like, during the vacuuming operation.

BACKGROUND OF THE INVENTION

Stick type vacuum cleaners are known in which each of the cleaners is provided with a vacuum pump, a dirt tube and a porous bag for receiving the dirt entrained in the air stream and conducting the dirt into a reusable dirt cup that is attached to the housing of the vacuum cleaner. Such an arrangement is shown in U.S. Pat. No. 3,199,138 to Nordeen. However, in the prior art stick type vacuum cleaners the handles are not adapted for multiple uses and, for example, it is difficult to vacuum stairs with such a device since it is elongated and if it is held vertically both the stairs and the risers cannot be adequately cleaned. Consequently, it is an object of the present invention to provide a two position handle for a stick vacuum cleaner which can be used in one position for up-right cleaning and in another position for substantial horizontal cleaning in conjunction with a molded-in handle on the lower housing of the cleaner. Thus, stairs and risers can be adequately vacuumed.

The present vacuum cleaner is a light-weight, upright construction and includes a vacuum motor for drawing dirt laden air into a housing, and discharging the dirt and debris into a removable dirt cup, while the air is exhausted through the filter bag to the atmosphere.

It is another object of the present invention to provide a support beam, or post, for a vacuum cleaner bag, which is connected to the lower housing at one end and a handle at the other end, which is disposed outside of said bag and the dirt cup.

It is yet another object of the present invention to provide a dirt cup having a larger capacity than the usual receptacles for receiving dirt and debris picked-up by the vacuum cleaner.

It is an object of the present invention to provide an integral molded-in hand hold in the lower housing of the vacuum cleaner for assisting in the lifting of the nozzle of the vacuum cleaner during stair cleaning operation.

It is a feature of the present invention to provide a construction for a light weight upright vacuum cleaner which is provided with a porous filter bag which has an unobstructed interior for permitting free passage of the air therethrough.

BRIEF DESCRIPTION OF THE DRAWINGS

In order that the invention be more clearly understood, it will now be disclosed in greater detail with reference to the accompanying drawings, wherein:

FIG. 7 is a perspective of the stick vacuum cleaner shown in a substantially horizontal position for vacuuming stairs or the like.

FIG. 12 is a top plan view of another embodiment of the nozzle incorporating a foot pedal switch.

FIG. 13 is a bottom plan view thereof.

DESCRIPTION OF THE PREFERRED EMBODIMENT

Figure 2:
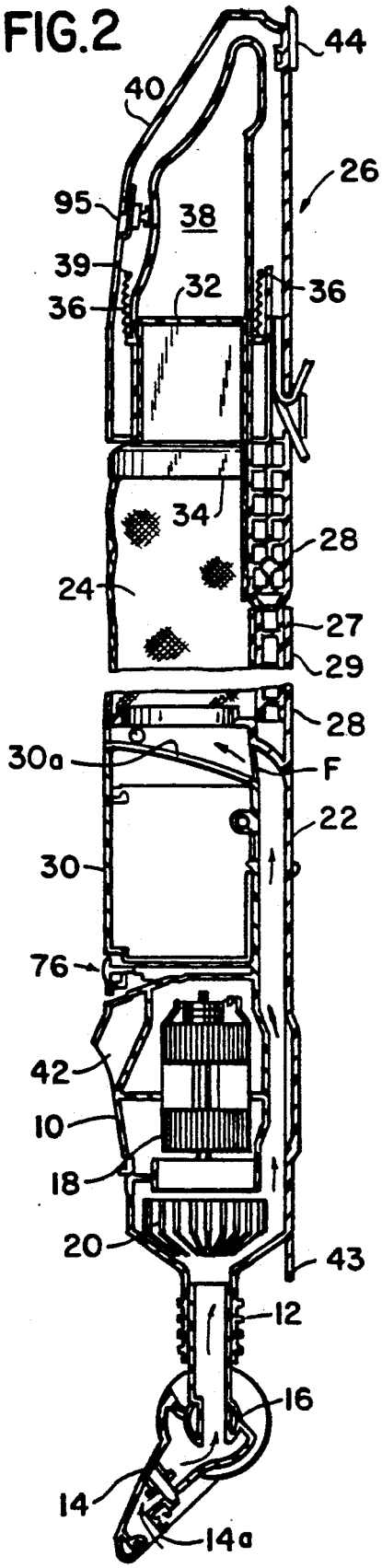
FIG. 2 is a cross-sectional view the device shown in FIG. 1.
Figure 1:
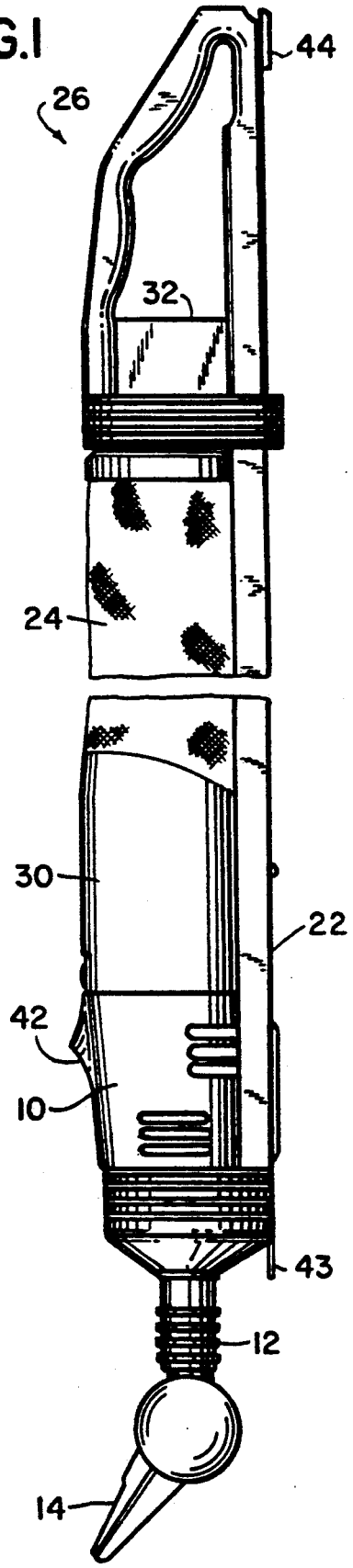
FIG. 1 is a side elevation view of the stick vacuum cleaner constructed in accordance with the teachings of the present invention.

The lightweight stick type vacuum cleaner, as seen in FIGS. 1–4, is provided with a lower housing 10 having a tubular extension 12 and the nozzle 14 pivotally attached to the extension 12 at pivot point 16. As seen in FIG. 2, an electric motor 18 and an impeller fan 20 are mounted in the lower housing 10 forming a vacuum pump for the cleaner. A dirt tube 22 is also provided for conducting air-entrained dirt into a porous filter bag 24.

The lower housing is connected to the upper handle assembly 26 by means of a cylindrical handle tube 28 located behind the porous bag and removable dirt cup 30. Consequently, dirt-laden air which enters the vacuum cleaner device through the opening 14*a* in the nozzle moves through the dirt tube 22 and exits through the flap F into the bottom of the porous cloth filter bag 24, and thereafter the air-entrained dirt falls by gravity into the dirt cup 30, while the air flow continues up into the filter bag 24 and out to the atmosphere through the minute openings of the filter bag. However, sometimes in use, some dirt and debris clings to the inside of the porous bag 24 and is removed by means of a bag shaker 32 having a lower ring 34 attached to the top of the filter bag 24. The bag shaker 32 is provided at its upper end with a pair of springs 36, each being attached at one end to the shaker mechanism 32 and at the other end to the handle assembly 26.

It should be noted that the handle assembly is in the form of a closed loop provided a void 38 for inserting the fingers of the hand therethrough.

Figure 3:
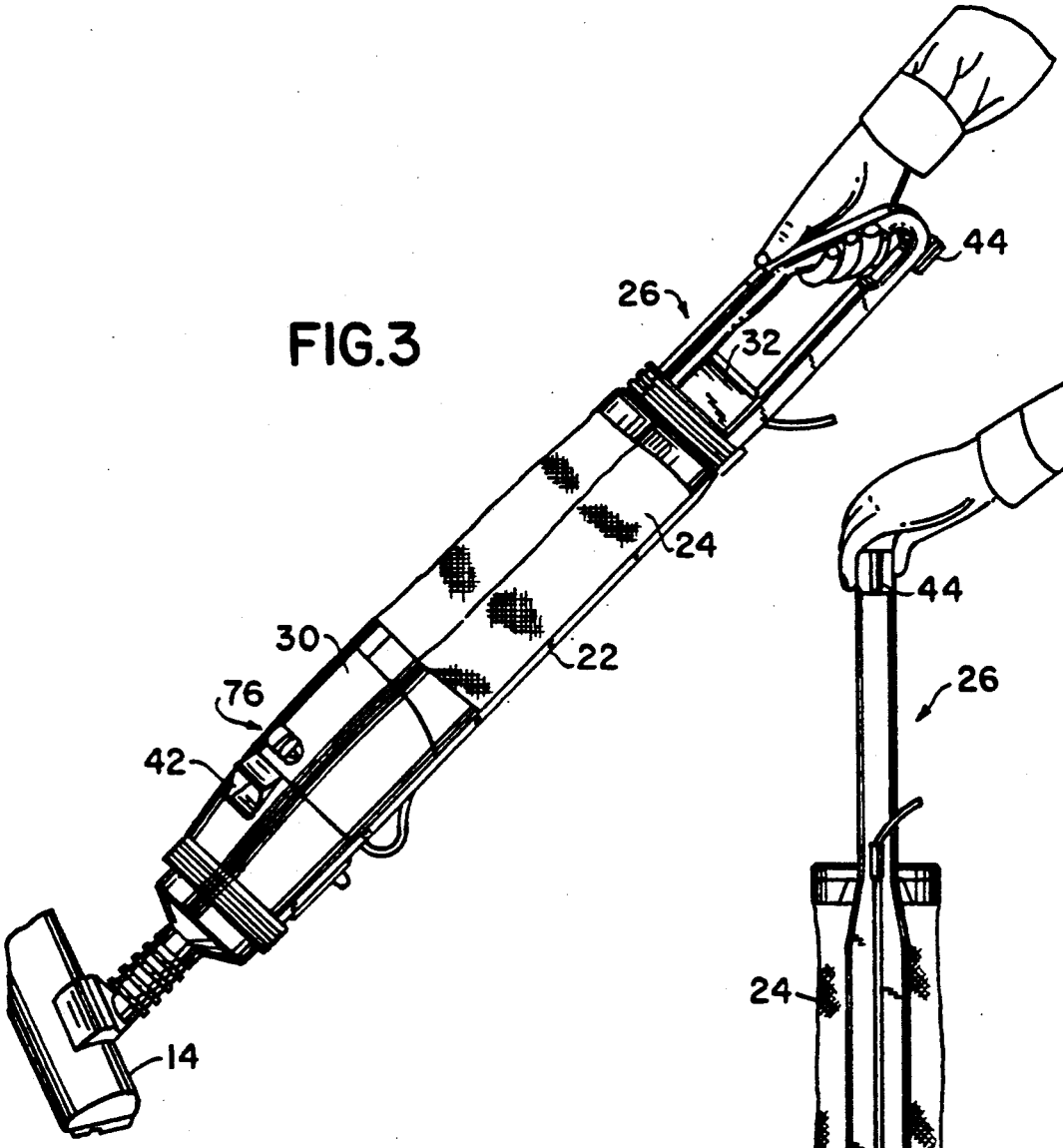
FIG. 3 is a substantially perspective view of the stick vacuum cleaner in use on a floor or floor covering.
Figure 4:
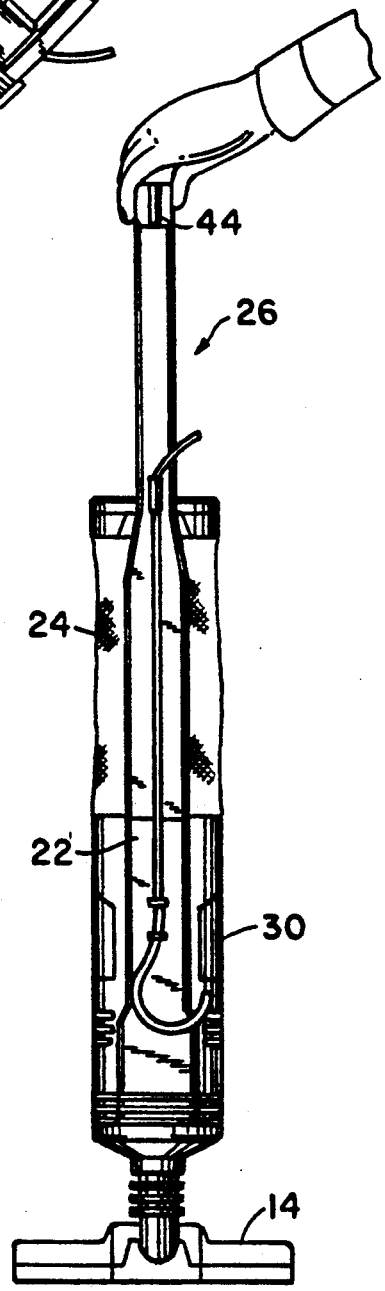
FIG. 4 is a rear elevation view of a vacuum cleaner shown in FIG. 3.
Figure 5:
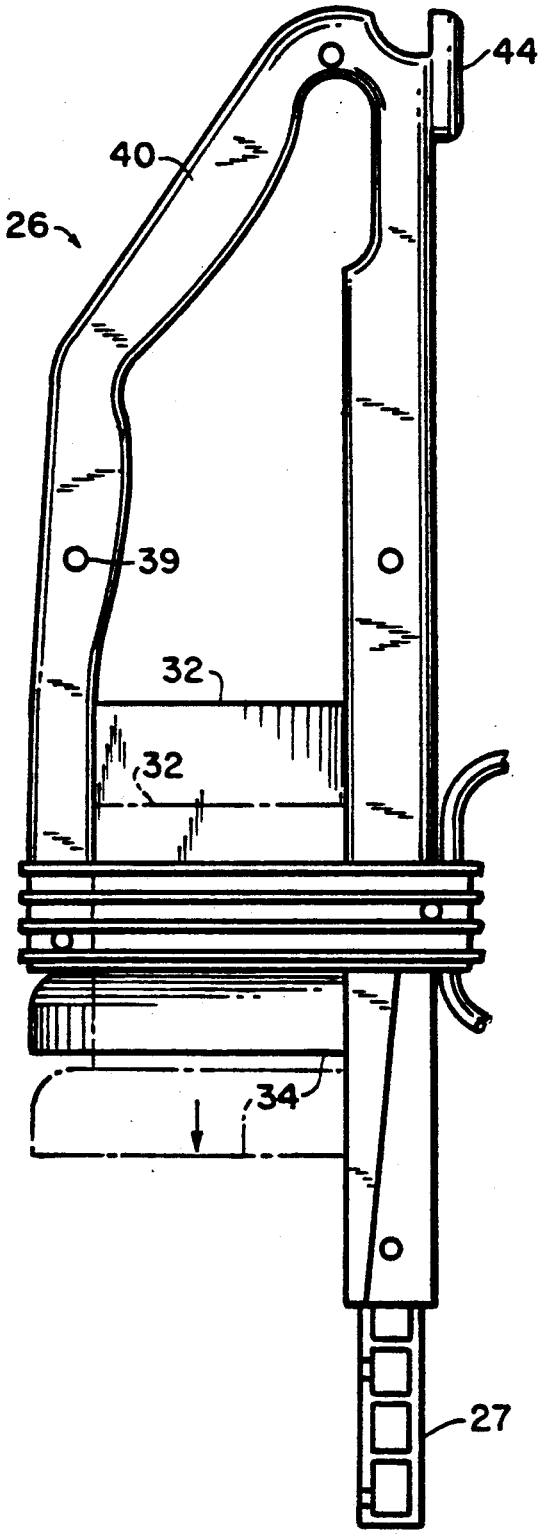
FIG. 5 is an enlarged side elevational view of the handle portion of the vacuum cleaner.
Figure 6:
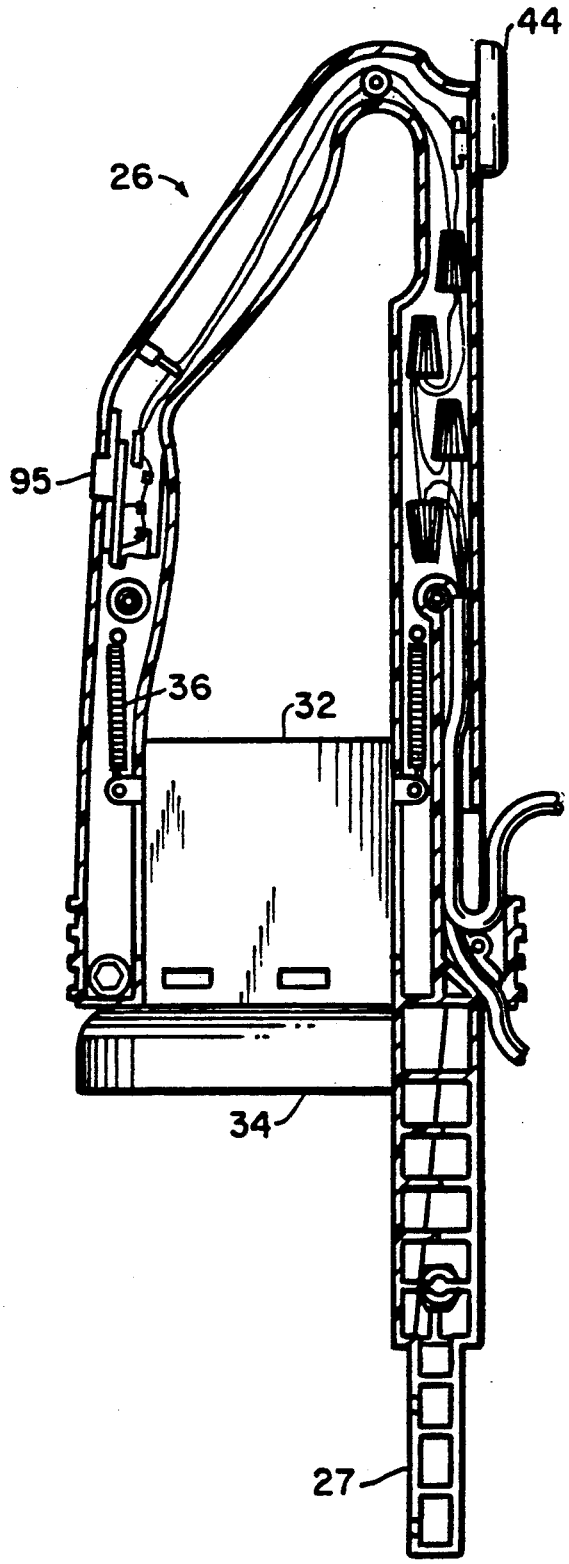
FIG. 6 is a cross-sectional view of the handle shown in FIG. 5.
Figure 7:
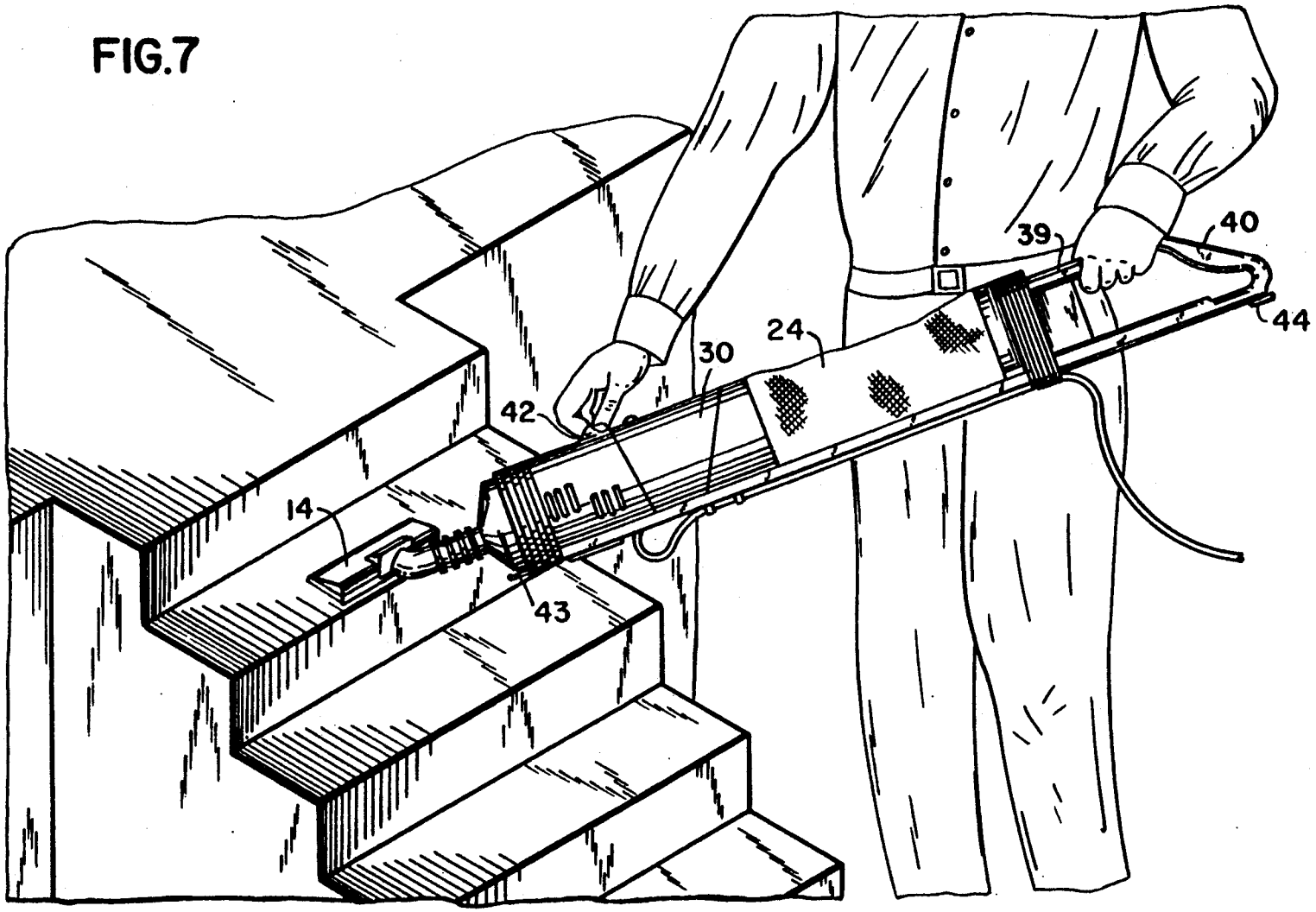

Referring particularly to FIGS. 5 and 6 showing the handle portion 26 of the vacuum cleaner which has a two-position hand grip, in which one hand grip portion 39 is substantially linear, and in which a second handle portion 40 is integral with the hand grip portion 39, and is at an obtuse angle thereto. Thus, the user/operator of the vacuum cleaner will use the handle portion 40 when the cleaner is held at an angle for cleaning floors and floor coverings, as seen in FIG. 3, and the handle portion 39 is utilized when vacuuming stairs and risers, as seen in FIG. 7. In order to make the vacuuming of stairs and risers easier to accomplish a hand-hold 42 is provided in lower housing 10 which particularly utilizes the construction, seen in FIG. 7, as well as in FIGS. 1-3.

As illustrated in FIG. 2, the handle 26 is provided with a reduced cylindrical insert 27 which fits within an end 29 of the cylindrical handle tube 28 which connects the lower housing to the handle assembly.

At the bottom of the handle 26 is a cord retainer 43 while at the top of handle 26 is mounted a cord retainer 44, for wrapping the electric power cord when not in use. As further seen in FIGS. 5 and 6, the hand grip portions 39 and 40 are shaped for gripping the selected handle portion without the operator's hand slipping out of position.

Figure 2A:
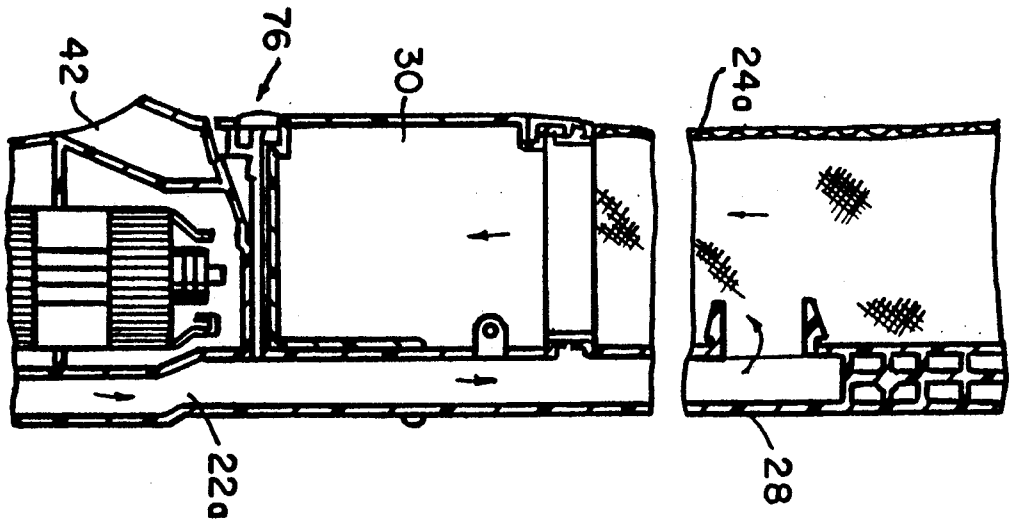
FIG. 2*a* is an alternate embodiment of the dirt tube location in the present invention.

An alternate embodiment of the present invention is illustrated in FIG. 2*a* showing the dirt tube 22*a* extending behind the dirt cup 30 and entering the porous filter bag 24*a* at an intermediate portion thereof, or at top of the bag. In this construction, the dirt tube functions not only to conduct the dirt-laden air into the filter bag but also acts as the connecting support member between the lower housing 10 and the handle assembly.

Figure 10:
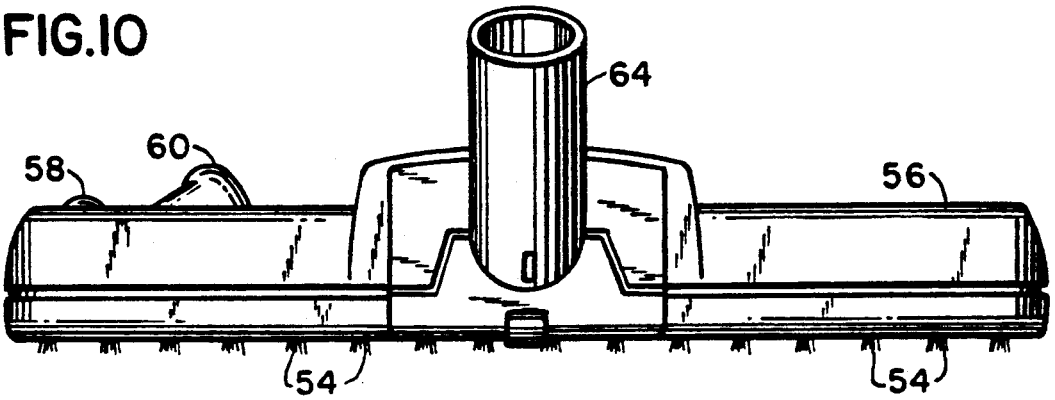
FIG. 10 is a rear view of the nozzle shown in FIG. 9.
Figure 11:
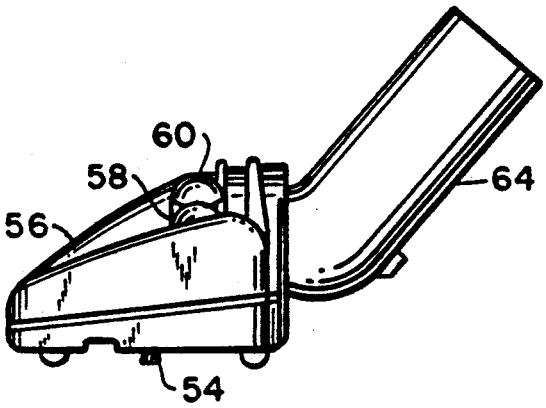
FIG. 11 is a side elevational view thereof.

The nozzle of the present stick vacuum cleaner is provided with a small wheel assembly 50 as shown in FIGS. 9-13. The nozzle opening 52 is provided with a bristle strip 54, as clearly seen in FIGS. 9 and 10. In addition, the nozzle housing 56 has an opening 58 through which a rocker foot pedal 60 projects, as shown in FIGS. 10.

Figure 14:
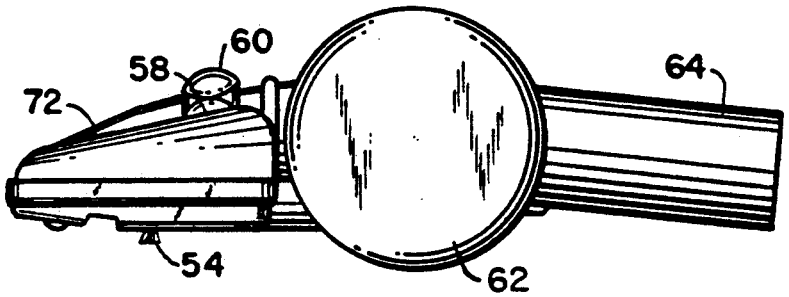
FIG. 14 is a side elevation thereof.
Figure 15:
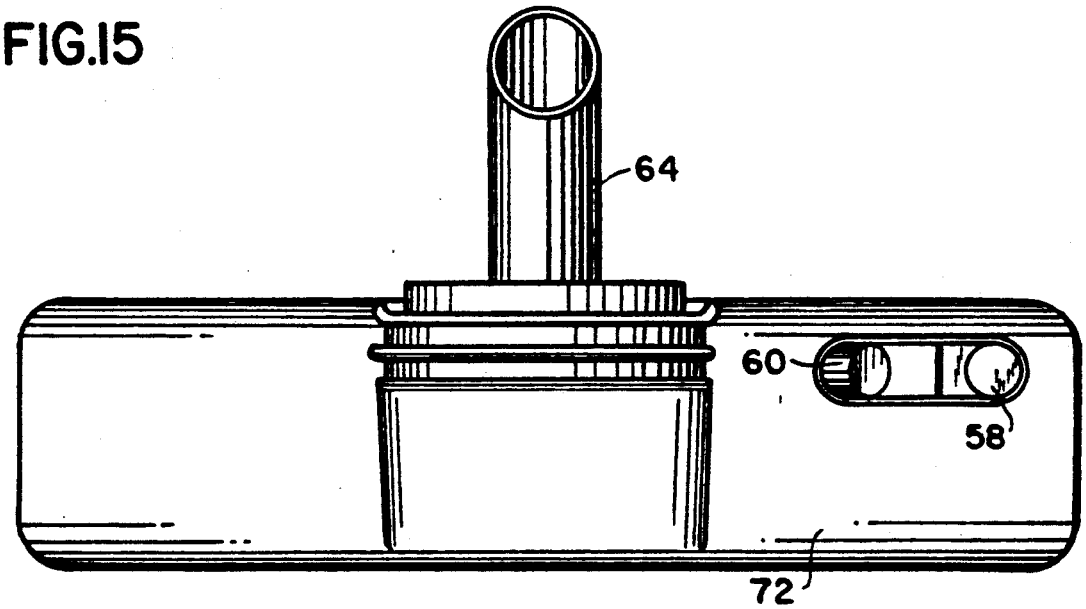
FIG. 15 is a top plan view showing the foot pedal switch of the embodiment shown in FIG. 9, 10 and 11.
Figure 17:
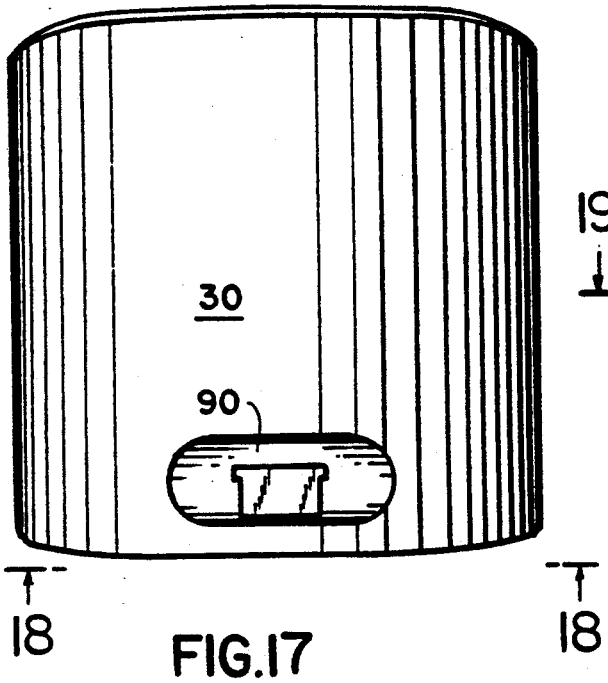
FIG. 17 is a front elevational view thereof.
Figure 16:
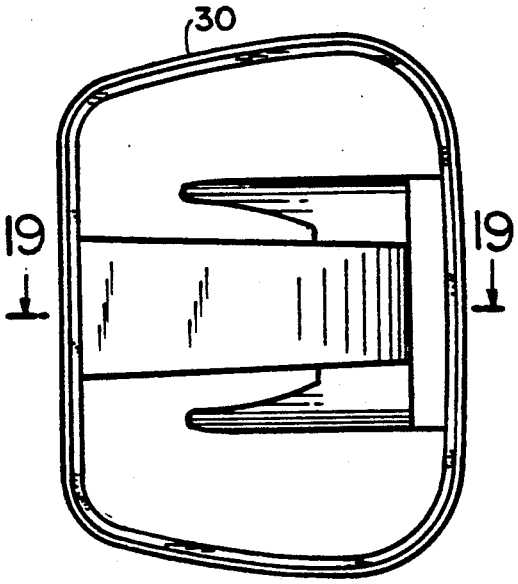
FIG. 16 is a top plan view of the dirt cup for the stick vacuum cleaner.

The embodiment shown in FIGS. 12-14 is provided with large nozzle propelling wheels 62 for ease in movement of the nozzle head. Pivotally secured to the nozzle casing 56 is an elbow 64 for insertion within the tubular extension 12 of the lower housing 10, as particularly seen in FIG. 2. As seen in FIG. 13 the alternate embodiment of the nozzle construction is provided with a bristle strip 68 in the opening 70 of the nozzle housing 72.

Figure 8:
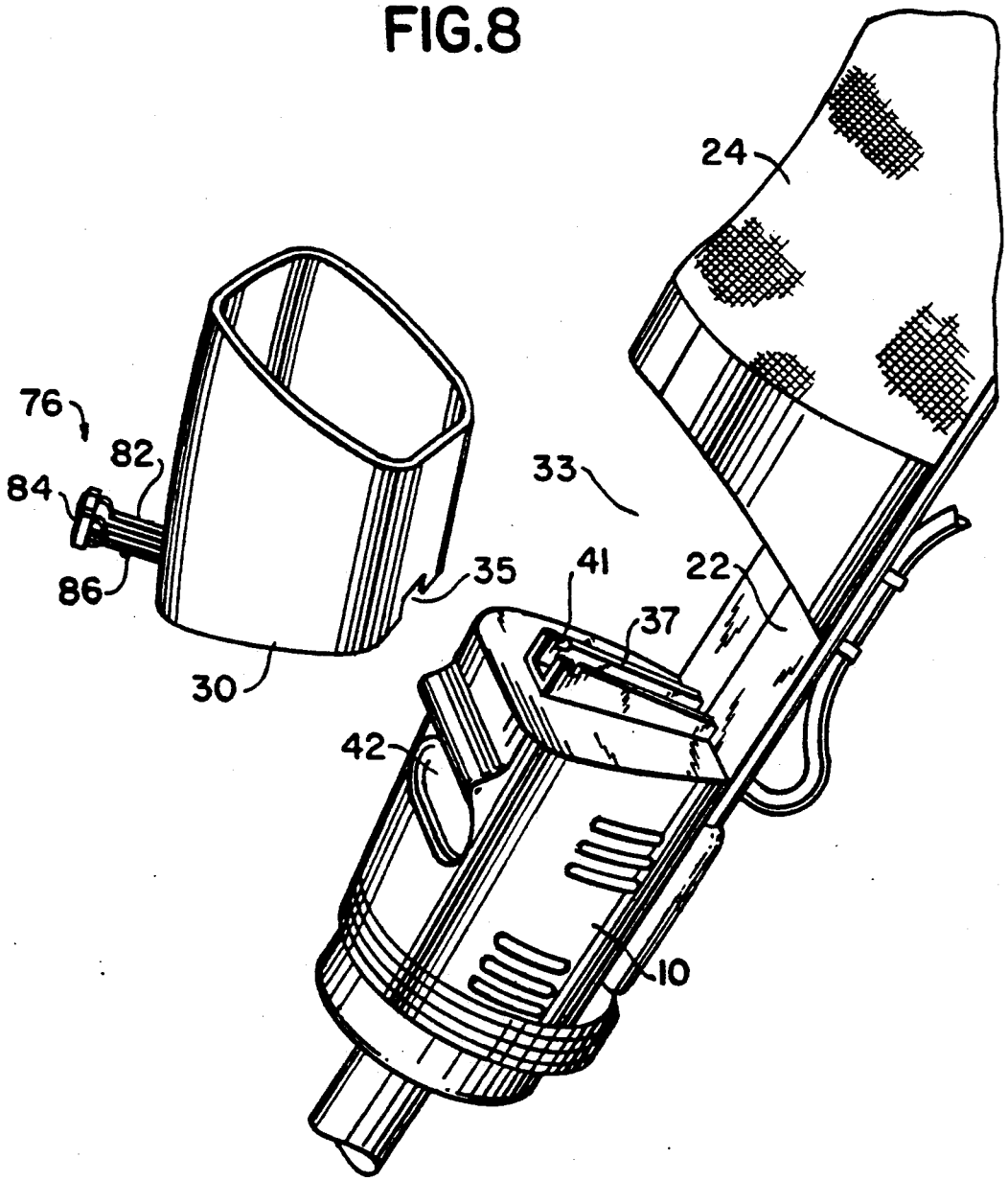
FIG. 8 is an enlarged fragmentary exploded view of the invention showing the dirt cup removed from the device and also showing the motor housing and porous filter bag.
Figure 9:
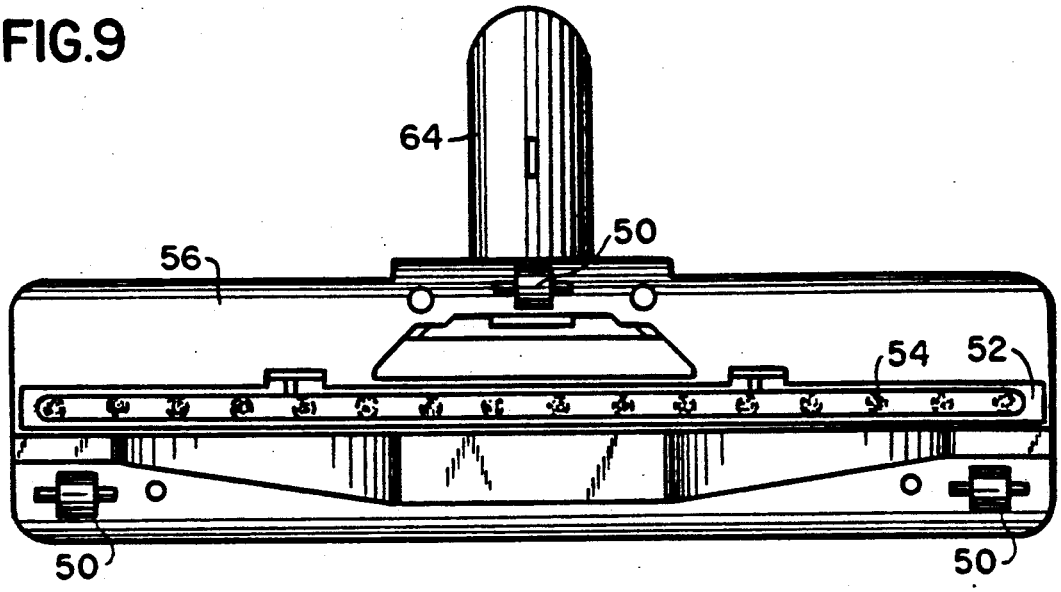
FIG. 9 is a bottom plan view of the nozzle for the stick vacuum cleaner showing the bristle strip, as well as the wheel assembly.

A removable dirt cup 30 is illustrated in FIGS. 8 and 6-19, and which is adapted to be inserted in the opening 33 between the hand hold 42 and the porous cloth bag 24, (FIG. 8). The dirt cup 30 is provided with a latch assembly referred to generally by the reference numeral 76, and particularly shown in FIGS. 20-25 of the drawings. As seen in FIG. 8 the dirt cup has a keyway 35 in the bottom thereof for accommodating the latch assembly 76, and a track 37 on the top surface of the lower housing 10. The latch assembly 76, in addition, is provided with somewhat flexible legs 78 having end hooks 80. Furthermore, the latch assembly 76 is provided with an element 82 having slightly flexible finger pieces 84, as well as a cam 86 on the bottom of the latch. The latch assembly 76 fits within the dirt cup 30 and has limited movement therein but cannot be removed therefrom. Consequently, when it is desired to install the dirt cup 30 within the opening between the lower motor housing and cloth dirt bag, the cup 30 is pushed into the opening and slides on the track 37 on the lower housing 10 and the cam 86 located on the bottom of the latch wedges against the lower housing of the vacuum cleaner thus locking the dirt cup in place on the stick vacuum. Since the latch assembly 76 moves freely with limited movement within the dirt cup the latter can be retracted by squeezing the latch finger pieces 84 and pulling out the latch assembly whereby the cam 86 is released from the lower housing. The latch assembly, how ever, cannot be separated from the dirt cup since it is retained within the cup by the end hooks 80 of the legs 78 being retained in the keyways 35 of the dirt cup 30.

Figure 19:
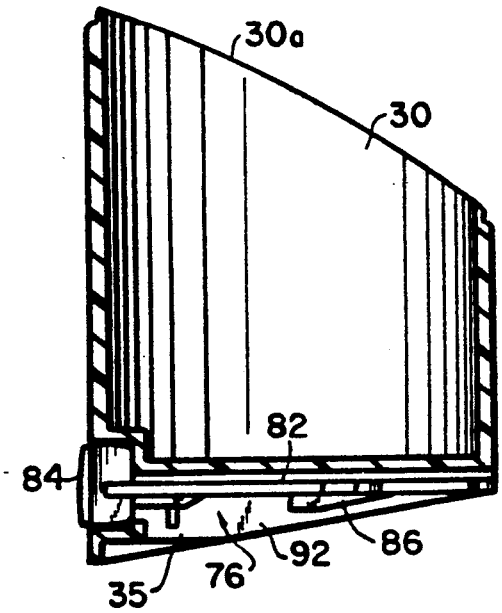
FIG. 19 is a sectional view taken along the lines 19—19 of FIG. 16.
Figure 18:
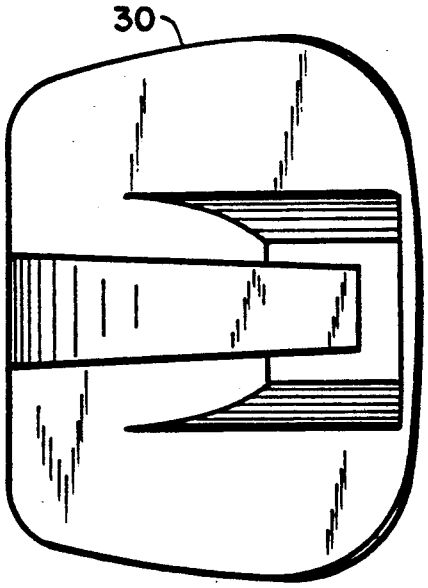
FIG. 18 is a view taken along the lines 18—18 of FIG. 7.
Figure 20:
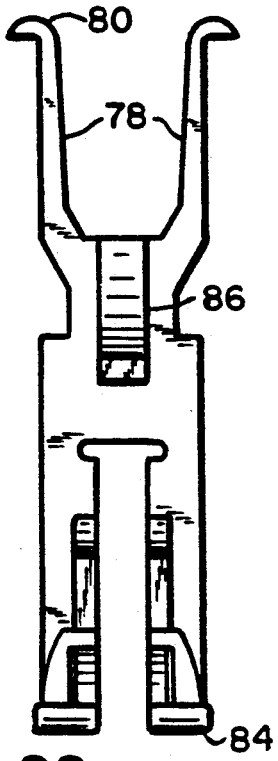
FIG. 20 is a front elevational view of the latch device which is movable within the dirt cup for securing and releasing the dirt cup from the vacuum cleaner.
Figure 21:
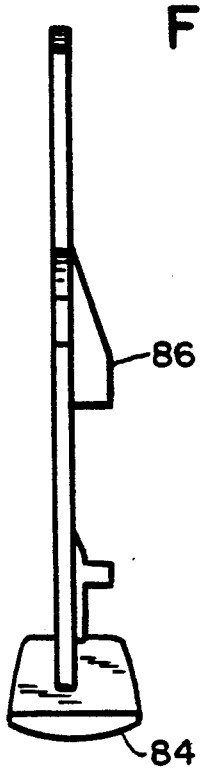
FIG. 21 is a side elevational view thereof.
Figure 22:
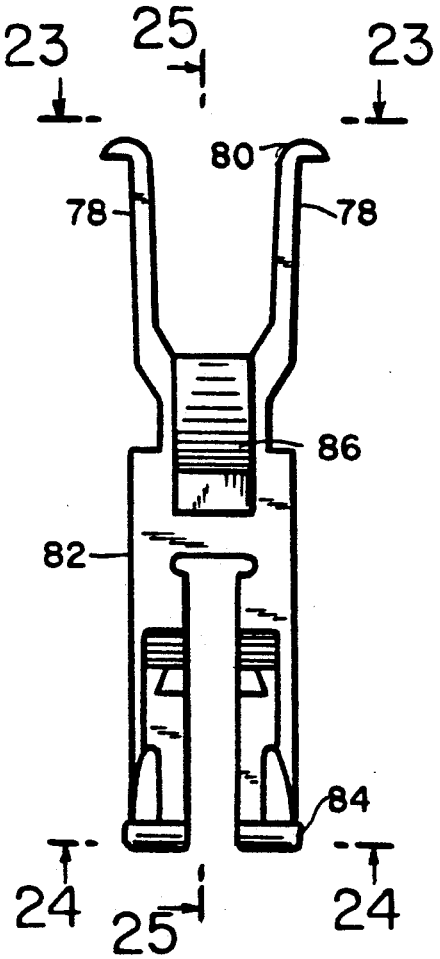
FIG. 22 is a rear elevational view of the latch shown in FIG. 20.
Figure 23:
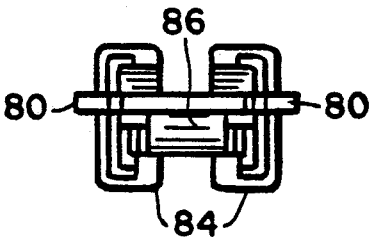
FIG. 23 is a view taken along the lines 23—23 of FIG. 22.
Figure 24:
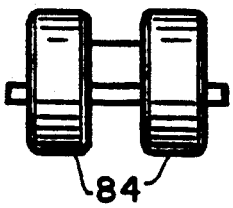
FIG. 24 is a view taken along the lines 24—24 of FIG. 22.
Figure 25:
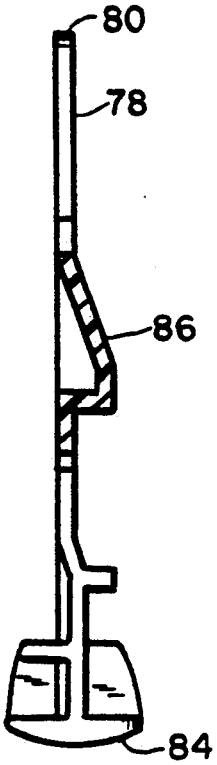
FIG. 25 is a view taken along the lines 25—25 of FIG. 22.

FIG. 19 shows the latch assembly 76 fully inserted within the keyway 35 of the dirt cup 30. It will again be noted that when the dirt cup 30 is pushed in the opening 33 and assumes the position shown in FIG. 2 the cam 86 of the latch assembly 76 is forced into engagement with the top surface of the lower housing 10 thereby maintaining the dirt cup into a latched position in the open space 33 between the bottom of the porous cloth bag 24 and the top of the lower housing 10.

As seen in FIG. 2, the dirt cup is provided with an open top 30*a* communicated with the porous bag 24 in order to permit the free fall of air-entrained dirt into the dirt cup 30. Furthermore, as stated above, the dirt cup 30 can be removed from the stick vacuum cleaner by grasping the finger pieces 84 on the latch assembly 76 and pulling the latch in a direction out of the dirt cup a limited distance thereby causing the cam 86 to be dislodged from engagement with the top surface of the lower housing 10.

As seen in FIGS. 1-6 an on/off switch 95 is shown which is connected to a power source (not shown) and which is provided in the handle 26 for operating the present stick vacuum cleaner.

While the invention had been disclosed and described herein with reference to a certain embodiment, it is apparent that other variations and modifications may be made which will fall within the true spirit and scope of the inventions, as defined in the following claims.

What we claim is:

1. In an upright stick-type vacuum cleaner having a lower housing, a nozzle movably attached to said lower housing, a handle, a support member connecting said lower housing to the handle, a vacuum pump, a porous bag, a dirt cup on the support member between the handle and the lower housing and a dirt tube for connecting dust and dirt laden air whereby said dust and dirt is deposited in said dirt cup while the air passes through said porous bag to the atmosphere, the improvement comprising a hand grip on said lower housing beneath the dirt cup and said handle having two alternate grasping positions, one of said positions being for upright cleaning operation of the vacuum cleaner and the other position together with said hand grip being for above-floor cleaning operation of the vacuum cleaner, and the dirt cup having a finger-operated latch fixedly mounted for restricted movement on the bottom of said dirt cup, said latch having a cam for frictional engagement between the bottom of the dirt cup and a top surface of said lower housing when said dirt cup is inserted in said vacuum cleaner.

2. The vacuum cleaner as claimed in claim 1 wherein said handle is loop-shaped.

3. The vacuum cleaner as claimed in claim 1 wherein said support member is an elongated rigid element that is located outside of said porous bag and said dirt cup.

4. The vacuum cleaner as claimed in claim 2, wherein said loop shaped handle has a linear gripping portion provided with a first handle gripping section and an integral second handle gripping section angularly disposed relative thereto.

5. The vacuum cleaner as claimed in claim 1, wherein the dirt cup is removable from the lower housing without removing the porous bag.

6. The vacuum cleaner as claimed in claim 1, wherein the movement of the latch is restricted by the latch being retained within keyways on the bottom of the dirt cup.

7. In an upright stick-type vacuum cleaner having a lower housing, a nozzle movably attached to the lower housing, a handle, a hand grip on the lower housing, a support member connecting the lower housing to the handle, a vacuum pump, a porous bag, a dirt cup and a dirt tube for connecting dust and dirt laden air whereby the dust and dirt is deposited in the dirt cup while the air passes through the porous bag to the atmosphere, the improvement comprising a finger-operated latch fixedly mounted for restricted movement on the bottom of the dirt cup, the latch having a cam for frictionally engaging a top surface of the lower housing when the dirt cup is inserted in the vacuum cleaner.

8. The vacuum cleaner as claimed in claim 7, wherein the dirt cup is removable from the lower housing without removing the porous bag.

9. The vacuum cleaner as claimed in claim 7, wherein the movement of the latch is restricted by the latch being retained within keyways on the bottom of the dirt cup.

10. The vacuum cleaner as claimed in claim 7, comprising in addition a hand grip on the lower housing and wherein the handle has two alternate grasping positions, one of the positions being for upright cleaning operation of the vacuum cleaner and the other position together with the hand grip being for above-floor cleaning operation of the vacuum cleaner.

11. In an upright stick-type vacuum cleaner having a lower housing, an nozzle movably attached to the lower housing, a loop-shaped handle, a hand grip on the lower housing, a support member connecting the lower housing to the handle, a vacuum pump, a porous bag, a dirt cup and a dirt tube for connecting dust and dirt laden air whereby the dust and dirt is deposited in the dirt cup while the air passes through the porous bag to the atmosphere, the improvement comprising a shaker having an actuating portion extending into the loop-shaped handle and connected to the porous bag whereby the porous bag can be shaken by actuating the actuating portion in the handle, the shaker being mounted on the support member which is an elongated rigid element that is outside the porous bag and the dirt cup.

12. The vacuum cleaner as claimed in claim 11, wherein the shaker is connected to the top of the porous bag and the actuating portion extends into the lower end of the loop-shaped handle.

13. The vacuum cleaner as claimed in claim 12, wherein the actuating portion is located above the top of the porous bag.

14. The vacuum cleaner as claimed in claim 11, comprising in addition a hand grip on the lower housing and wherein the handle has two alternate grasping positions, one of the positions being for upright cleaning operation of the vacuum cleaner and the other position together with the hand grip being for above-floor cleaning operation of the vacuum cleaner.

* * * * *

UNITED STATES PATENT AND TRADEMARK OFFICE

CERTIFICATE OF CORRECTION

PATENT NO. : 5,107,567

DATED : April 28, 1992

INVENTOR(S) : Marco Ferrari et al.

It is certified that error appears in the above-identified patent and that said Letters Patent is hereby corrected as shown below:

On the title page, under references cited, "4,758,914" should be --3,758,914--.

Column 2, line 31, "7." should be --17.--

Column 3, line 60, "6-19" should be --16-19--.

Column 4, line 18, "how ever" should be --however--.

Column 5, line 10, "linear" should be --handle--.

Column 6, line 11, "an" should be --a--.

Signed and Sealed this

Tenth Day of August, 1993

*Attest:*

Michael K. Kirk

MICHAEL K. KIRK

*Attesting Officer*

*Acting Commissioner of Patents and Trademarks*